United States Patent [19]

Siwersson et al.

[11] Patent Number: 4,803,932

[45] **Date of Patent: * Feb. 14, 1989**

[54] BURNER FOR A SUSPENSION OF FINE-GRAINED COAL IN LIQUID

[75] Inventors: Olle L. Siwersson, Helsingborg; Arne E. Wall, Landskrona; Jan A. T. Loodberg, Nyhamnsläge, all of Sweden

[73] Assignee: AB Scaniainventor, Helsingborg, Sweden

[ * ] Notice: The portion of the term of this patent subsequent to Apr. 14, 2004 has been disclaimed.

[21] Appl. No.: 129,892

[22] Filed: Nov. 10, 1987

Related U.S. Application Data

[63] Continuation of Ser. No. 783,396, Oct. 3, 1985, abandoned, which is a continuation of Ser. No. 690,548, Jan. 11, 1985, abandoned, which is a continuation of Ser. No. 543,596, Oct. 19, 1983, abandoned, which is a continuation of Ser. No. 367,145, Apr. 9, 1982, abandoned, which is a continuation of Ser. No. 261,322, May 7, 1981, abandoned, which is a continuation of Ser. No. 58,409, Jul. 17, 1979, abandoned.

[30] Foreign Application Priority Data

Jul. 31, 1978 [SE] Sweden ..... 808371

[51] Int. Cl.[4] ..... F23C 1/02

[52] U.S. Cl. ..... 110/260; 110/261; 110/264; 239/214.17; 431/168

[58] Field of Search ..... 110/260–265, 110/347; 239/214.17; 431/168

[56] References Cited

U.S. PATENT DOCUMENTS

| | | | |
|---|---|---|---|
| 1,468,008 | 9/1923 | Dyson | 110/261 |
| 1,695,030 | 12/1928 | Scheminger, Jr. | 431/168 |
| 1,707,774 | 4/1929 | Scheminger, Jr. | 431/168 |
| 2,099,092 | 11/1937 | Arnold | 431/168 |
| 2,389,027 | 11/1945 | Corbin et al. | 431/168 |
| 3,220,457 | 11/1965 | Bailey | 431/168 |
| 3,447,494 | 6/1969 | Schwarz et al. | 110/264 |
| 3,508,852 | 4/1970 | Hourwitz et al. | 431/168 |
| 4,113,421 | 9/1978 | Miyahara | 239/214.17 |

FOREIGN PATENT DOCUMENTS

| | | |
|---|---|---|
| 1087311 | 8/1960 | Fed. Rep. of Germany . |
| 1128077 | 9/1968 | United Kingdom . |

*Primary Examiner*—Henry C. Yuen
*Attorney, Agent, or Firm*—Beveridge, DeGrandi & Weilacher

[57] ABSTRACT

Burner for a suspension of fine-grained coal in a liquid, particularly water, which burner operates according to a combination of the rotary burner and toroidal burner principles. The fuel is supplied axially behind a transverse distribution baffle within a conical rotary body. At least the outer rim portion of the inner side of the rotary body forms an angle of 35°–80° with the axis of the burner. At the outer edge of the rotary body there is an annular air supply nozzle for supplying a conically diverging outwardly directed air stream. Outside the air supply nozzle and at a radial distance from it, there is a conical guide baffle (18, 48) which at its outer end may be curved inwardly and which, together with the diverging air stream, serves to produce a positive recirculation of combustion gases, non-combusted coal particles and ash particles in a direction back towards the rotary body in accordance with the toroidal burner principle.

12 Claims, 5 Drawing Sheets

21
22
20
20
δ
18
β
α
γ
13
12
17
17
15
19
16
23
10
14
11
M

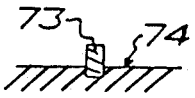
FIG. 10
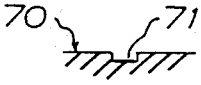
FIG. 8
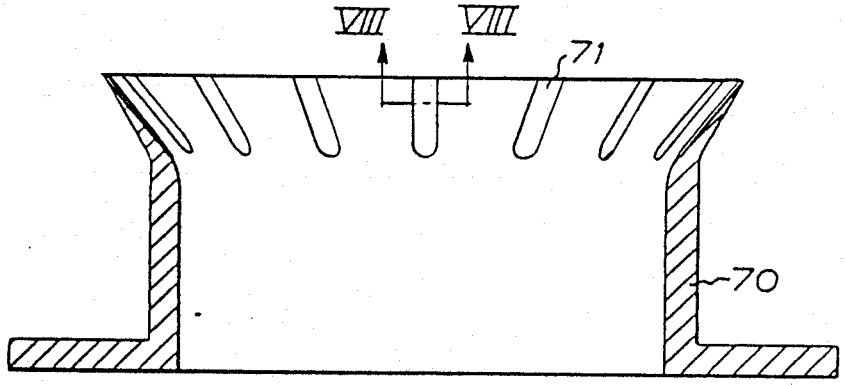
FIG. 6
FIG. 9
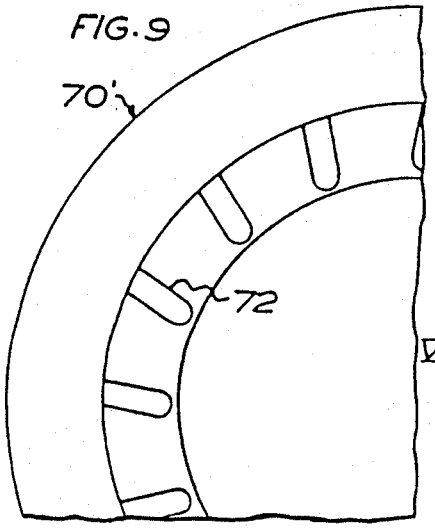
FIG. 7
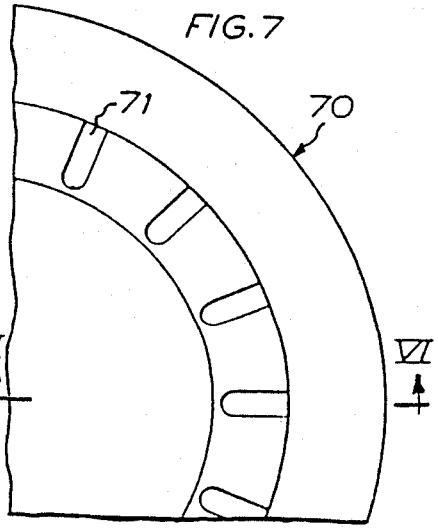

BURNER FOR A SUSPENSION OF FINE-GRAINED COAL IN LIQUID

This application is a continuation of application Ser. No. 783,396, filed Oct. 3, 1985 now abandoned, which is a continuation of application Ser. No. 690,548 filed Jan. 11, 1985, and now abandoned, which was a continuation of application Ser. No. 543,596, filed Oct. 19, 1983 and now abandoned, which was a continuation of application Ser. No. 367,145 filed Apr. 9, 1982 and now abandoned, which was a continuation of application Ser. No. 261,322 filed May 7, 1981 and now abandoned, which was a continuation of application Ser. No. 58,409 filed July 17, 1979 and now abandoned.

The present invention relates to a burner particularly intended for the combustion of fuels consisting of suspensions of fine-grained coal particles in a liquid, in particular water containing a suspending agent. Over the years, different kinds of such fuels have been proposed, but in order that these fuels should be economically advantageous, it is essential that the amount of liquid in the suspension is kept low. The lower the liquid content is, the greater are the difficulties of handling the fuel. A newly developed type of such a coal suspension is described in e.g. U.S. Pat. Appln. Ser. No. 908,497. The fuel disclosed therein consists of a very finely divided coal dust suspended in a liquid which is usually water but which may also be combustible in itself. This liquid fuel contains a suspending agent for maintaining the coal powder particles in suspension. Typically, this fuel consists of about 70% by weight of coal, about 30% by weight of water, and a small amount of suspending or dispersing agent, for instance 0.3% by weight, calculated on the whole of the fuel. The viscosity of the fuel may amount to 2500 cP Brookfield, and the particle size of the coal typically is about 50 μm. The thermal value of the fuel typically is 21–25 MJ/kg (5.8–6.9 kWh/kg). A certain amount of fine-grained lime may also have been added to the fuel in order to neutralize the sulphur content of the coal. This fluid suspended fuel may be used as a substitute for oil and gas but it gives rise to difficulties when burnt because of the tendency of the fuel to choke channels and the like. Attempts have been made to use this combustible suspension in conventional oil and gas burners, which has met with great problems, such as plugging of nozzle orifices, unless these have had a diameter of at least about 4 mm, giving a low degree of atomization. Another possible solution disclosed in U.S. Pat. No. 3,447,494 is to use a rotary burner, i.e. a burner having a rotary fuel distributing cup, to the interior of which the fuel is supplied. The fuel mixture is expelled from the cup as a finely divided dust cloud. A conically converging air stream is directed towards this dust cloud from an annular nozzle surrounding the rotational cup of the rotary burner. This prior-art rotary burner as well as other known rotary burners for oil have however proved to be practically unusable, since, on the one hand, the fine-grained suspension showed a tendency to plug the flow channels and, on the other, the suspended particles had a tendency to stick to the inner side of the rotating burner cup and be burnt thereto.

A known oil burner type operates according to the so-called toroidal principle where the oil mist sprayed out from the nozzle is surrounded by a conically diverging air stream which, by a kind of ejector effect, produces a recirculation of the combustion gases inwards towards the oil burner nozzle. Attempts to use this known oil burner type for the combustion of the above-mentioned special fuel in the form of a suspension of fine-grained coal particles in a liquid have also failed, mainly because a sufficient degree of atomization could not be achieved in the nozzle, since a large cross-sectional diameter of the nozzle orifice was necessary in order to avoid plugging but also because of the inaptitude of the coal particles to take part in the recirculation of the combustion gases.

German Patent Specification No. 594,722 discloses an oil burner in which the fuel is supplied by selp-priming to the mouth of a pipe which extends into a rotary cup and terminates above the bottom thereof, such that the fuel is expelled towards the edge of the cup so as to be distributed by this edge into an air stream ascending around the rotary cup. Oil drops that are not entrained by the air stream are caught by a conical screen and flow down into an oil collector against the action of the ascending air stream which is produced by means of an annular nozzle disposed beneath the rotary cup. This prior-art oil burner rather operates in accordance with the rotary burner principle but not according to the above-mentioned toroidal principle since the gas velocity at the edge of the rotary cup is so low that it permits oil drops both to hit the surrounding screen and to descend along this screen. Nor is this known burner usable for the above-mentioned fuel in the form of a suspension of fine-grained coal particles in a liquid.

According to the present invention, it has quite surprisingly been discovered that by combining the per se known rotary burner principle with the per se known toroidal burner principle, it is possible to provide a burner which readily permits combustion of the above-mentioned suspended particulate fuel.

The object of the present invention is thus to provide a burner for a fuel consisting of a suspension of fine coal particles in a liquid, particularly water containing a suspending agent which burner is designed as a rotary burner with a conical rotary body, at the inner side of which the fuel is supplied so as to be conveyed by centrifugal force outwardly along the conical inner side of the rotary body of its outer peripheral edge, the burner having an air supply nozzle surrounding the rotary body and adapted to supply air along the peripheral edge of the rotary body.

According to the invention, at least the outer rim of the inner side of the rotary body forms an angle of 35°–80° with the axis of the burner; a distribution baffle is arranged transversely of the axis of the burner within the rotary body; an axially directed supply pipe for the suspension serving as fuel opens at a location behind said distribution baffle; and the burner further is adapted to operate according to the toroidal burner principle in that the air supply nozzle is disposed at the peripheral edge of the rotary body so as to supply the air as a diverging air stream directed outwards away from the axis of the burner, and in that the air supply nozzle and the rotary body are surrounded by a conical guide baffle which for the formation of a gap between the guide baffle and the air supply nozzle is radially spaced from the air supply nozzle and which forms approximately the same angle with the axis of the burner as the diverging air stream.

The diverging air stream preferably makes an angle of 30°–70° with the axis of the burner, this giving the best recirculation effect. It is possible further to enhance the recirculation effect if the conical guide baffle is provided at its outer end with an inwardly curved extension. This extension should then be curved according to the desired shape of the rotating toroidal gas body in front of the burner.

During its movement along the inner side of the rotating cup the suspension dries and much of the water or liquid has evaporated, when the suspension leaves the edge of the rotary cup and is flung out by centrifugal force. The coal particles will then be caught by the diverging air stream and entrained by it in recirculation. In order to facilitate the outward movement of the suspension and enhance the effect of the rotary cup, it is preferred according to the present invention if at least the outer rim of the conical inner side of the rotary cup forms a greater angle with the axis of the burner than the diverging air stream from the air supply nozzle. The inner side of the rotary cup may then be provided with conical steps which are disposed at different angles to the axis of the burner. As mentioned above, at least the outer rim of the conical inner side of the rotary cup shall make an angle of 35°–80° with the axis of the burner. By giving the inner side of the rotary cup a stepped configuration, it will be possible to enhance the effect of the burner in that the coal particles are "shaken apart" during their movement over the steps and in that the formation of irregular fluid streams will thereby be reduced.

In a particularly advantageous embodiment of the invention, the outer side of the rotary cup forms the inner boundary wall of the annular air nozzle. For practical reasons, it is then most convenient if the outer rim of the inner side of the rotary cup forms an angle with the axis of the burner that is at least 10° greater as compared with the conically diverging air stream from the annular air nozzle, since this will give sufficient structural strength to the edge of the rotary cup.

In a further development of the invention, it has been found that in many cases it is possible to gain certain advantages if the burning mass of gas and coal particles is prevented from rotating to too large an extent, which may be achieved if the air nozzle is provided with guide vanes or slots arranged to stabilize the air stream and to counteract such rotation about the axis of the burner.

In order to distribute the fuel on the inner side of the rotary cup, a distribution baffle according to the invention is disposed within the rotary cup transversely of the axis of the burner, an axially oriented supply pipe for the fuel suspension opening at a location behind this distribution baffle, at the outer edge of which there is an annular gap between the baffle and the rotary cup. It is also possible to let other fuel supply pipes open inwardly of this distribution baffle, if it is desired to combine the burner with an oil or gas burner, for instance for initiating the combustion process. In order to have a self-cleaning effect in the rotary cup, it is advantageous to mount the distribution baffle on the supply pipe, a relative movement being produced between the supply pipe and the rotary cup, for instance in that the supply pipe with the distribution baffle fixed thereto is stationary or caused to rotate at a different angular velocity.

The invention will be described in greater detail hereinbelow with reference to the accompanying drawings in which:

FIG. 6 is a modified embodiment of the outer boundary wall of an annular air supply nozzle in the burner according to the invention;

FIG. 7 is a top plan view of said outer boundary wall;

FIG. 8 is a sectional view taken along the line VIII—VIII in FIG. 6;

FIG. 9 is a view, corresponding to FIG. 7, of a further embodiment of the outer boundary wall of the air supply nozzle, according to the invention; and FIG. 10 is a section, corresponding to FIG. 8, of still another embodiment of the outer boundary wall of the air supply nozzle, according to the invention.

Figure 1:
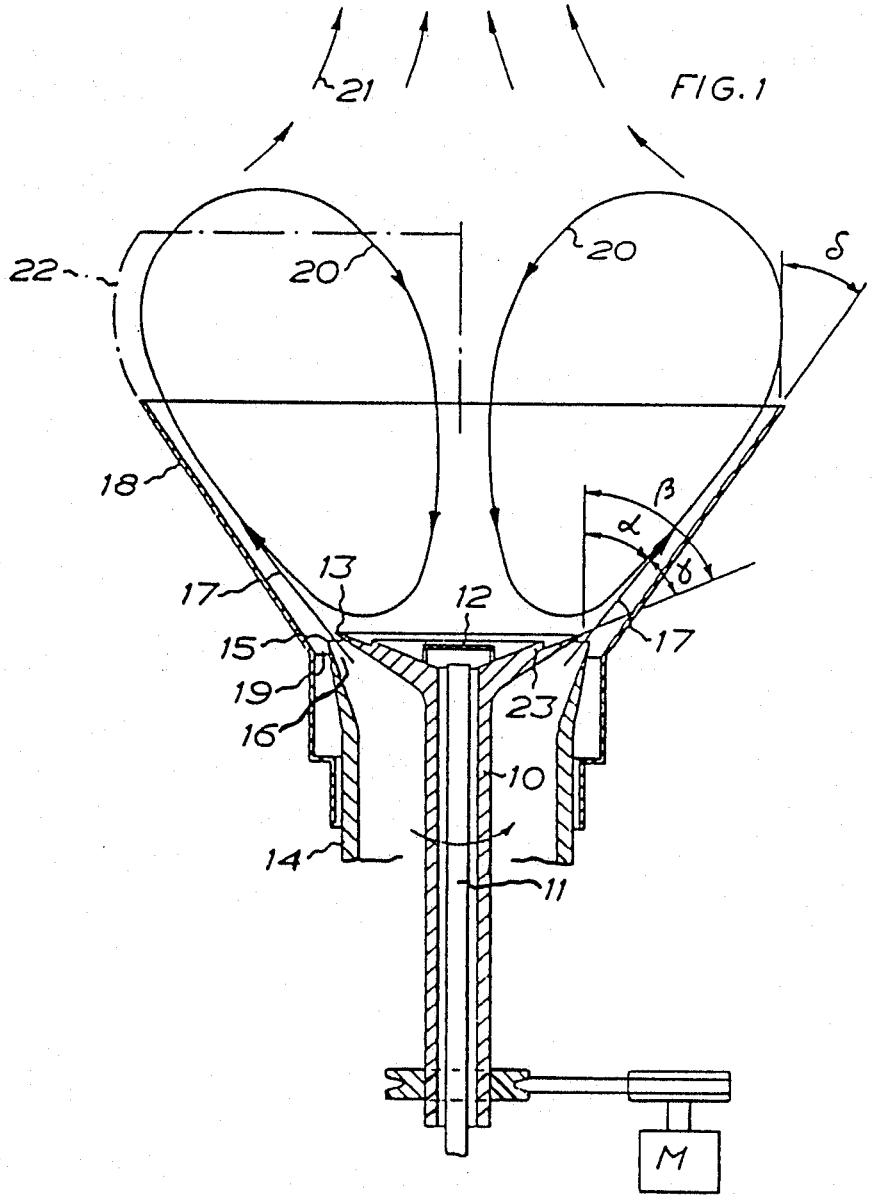
FIG. 1 is a diagrammatic sketch of a burner according to the present invention.

FIG. 1 diagrammatically shows the principle of a burner according to the present invention. The burner has a rotary cup or body 10 with a supply pipe 11 for a fuel in the form of a suspension of fine-grained coal in a liquid, particularly water. The supply pipe 11 opens at the conical inner side of the cup 10 at a location behind a distribution baffle 12 secured to the rotary body and serving to force the relatively viscous suspension out onto the inner surface of the rotary body 10. The body 10 is rotated by means of a drive M, and the suspension will then flow by centrifugal force out towards the circumferential edge 13 of the rotary body.

The body 10 is disposed in a primary air supply pipe 14 whose outer end edge 15, together with the edge 13 of the mouth of the rotary body, defines an annular air nozzle 16 through which a stream of primary air is ejected in the direction indicated by the arrows 17 as an air stream diverging conically outwardly, producing a kind of ejector effect in that the air stream has its maximum velocity precisely in the area of the peripheral edge of the rotary cup 10. The primary air stream 17 flows along the surface of a conical guide baffle 18 which extends from a location behind the nozzle 16 and is radially spaced from the nozzle in order to define a free gap 19 around the outer side of the primary air supply nozzle 16. This gap is important in so far as the coal particles expelled from the rotary cup 10 should not be flung straight out and directly hit the baffle 18 but should have enough time to change their direction of movement so as to be intercepted and entrained by the air stream 17.

By the per se known toroidal effect of the conically diverging air stream 17, this stream will turn inwards along arrows 20 so as to produce a standing vortex in the form of a deformed toroid forming the very combustion zone. A part of the gases leaves the combustion zone along arrows 21.

As indicated by dash-dotted lines, the conical baffle 18 may be provided, at its outer end, with an inwardly curved portion or extension 22 in order further to enhance the toroidal effect.

Tests have shown that the best results are obtained if the annular nozzle 16 directs the conically diverging air stream at an angle $\alpha$ of 30°–70° to the axial direction of the burner. The conical portion of the guide baffle 18 should form approximately the same angle with the axial direction of the burner, i.e. the angle $\delta$ should be approximately equal to or one or two degrees greater than the angle $\alpha$.

The inner side of the rotary cup 10 may be arranged at different angles to the longitudinal axis of the burner but for the fuel here discussed, consisting of a suspension of fine-grained coal in a liquid, typically water, an angle of 35°–80° to the axial direction of the burner is necessary for obtaining maximum effect and minimum fusion of the coal particles to the inner side of the rotary body. If the outer side of the rotary body is used as one boundary wall of the nozzle 16, as is the case in FIG. 1, it is best in actual practice if the angle $\gamma$, i.e. the angle between the conical air stream according to arrows 17 and at least the outer rim of the rotary body 10, is at least 10° so as to impart sufficient structural strength to the rim of the rotary body.

By designing the burner in such a manner that it works according to a combination of the rotary burner and toroidal burner principles, it is possible to obtain a stable combustion of the fuel suspension here contemplated. By this construction, it is possible to ensure that the supply pipe 11 has a diameter sufficient to permit conveyance of the suspension without the risk of plugging, and the atomization of the suspension is realized by the rotational effect of the rotary body 10, the toroidal effect being achieved in that the coal particles leaving the edge 13 of the mouth of the rotary body are affected by the outwardly expanding or diverging air stream 17 which thus will not change the direction of movement of the coal particles to too great an extent but only entrain them in the toroidal stream 20. When the coal particles not yet combusted leave the edge 13 and are entrained into the toroidal stream 20, the coal particles are allowed to burn during their relatively long stay in the combustion zone of the burner. This zone has been concentrated by toroidal effect such that the front of combustion will not leave the burner head proper which is formed by the guide baffle 18, the rotary body 10 and the air nozzle 16. Without the toroidal effect the front of combustion would have moved away from the burner head and the fuel would have become extinct.

When the burner of the invention is to be started, the coal suspension must be ignited with the aid of an ignition flame which, in an advantageous embodiment of the invention, may be produced by means of oil or gas fed into the rotary body through a separate oil or gas supply pipe which will be described in greater detail in connection with the other embodiments of the invention. Ignition is achieved in that oil is injected separately into the rotary body, i.e. at the same time as the fuel suspension. After an initial ignition period, the oil supply may be interrupted and the combustion will continue by means of the fuel suspension. When the required temperature has been attained, the combustion of the fuel suspension is maintained simply in that the burning coal powder particles flow back with the toroidal fuel gas stream 20 and, during their prolonged stay in the combustion zone, ignite new coal powder particles that are expelled from the edge 13 of the rotary body 10.

The rotary body or cup 10 in a burner according to the invention has a greater cone angle than what is normally the case in rotary burners, so as to ensure a reliable transfer of the coal suspension towards the edge 13 of the mouth of the body 10. During its movement along the inner side of the rotary body, the coal suspension will dry very rapidly and when the suspension leaves the edge 13, it may have passed into powder form. In order to facilitate the loosening or breaking up of the dried suspension and to ensure that the pulverulent coal leaves the rotary body as a finely divided cloud of dust, it is possible to give the inner side of the conical body a step-shaped configuration with a step 23 schematically shown in FIG. 1. This step will shake the powder particles loose from each other and thus prevents the formation of irregular fuel streams. More than one step 23 may be used.

Figure 2:
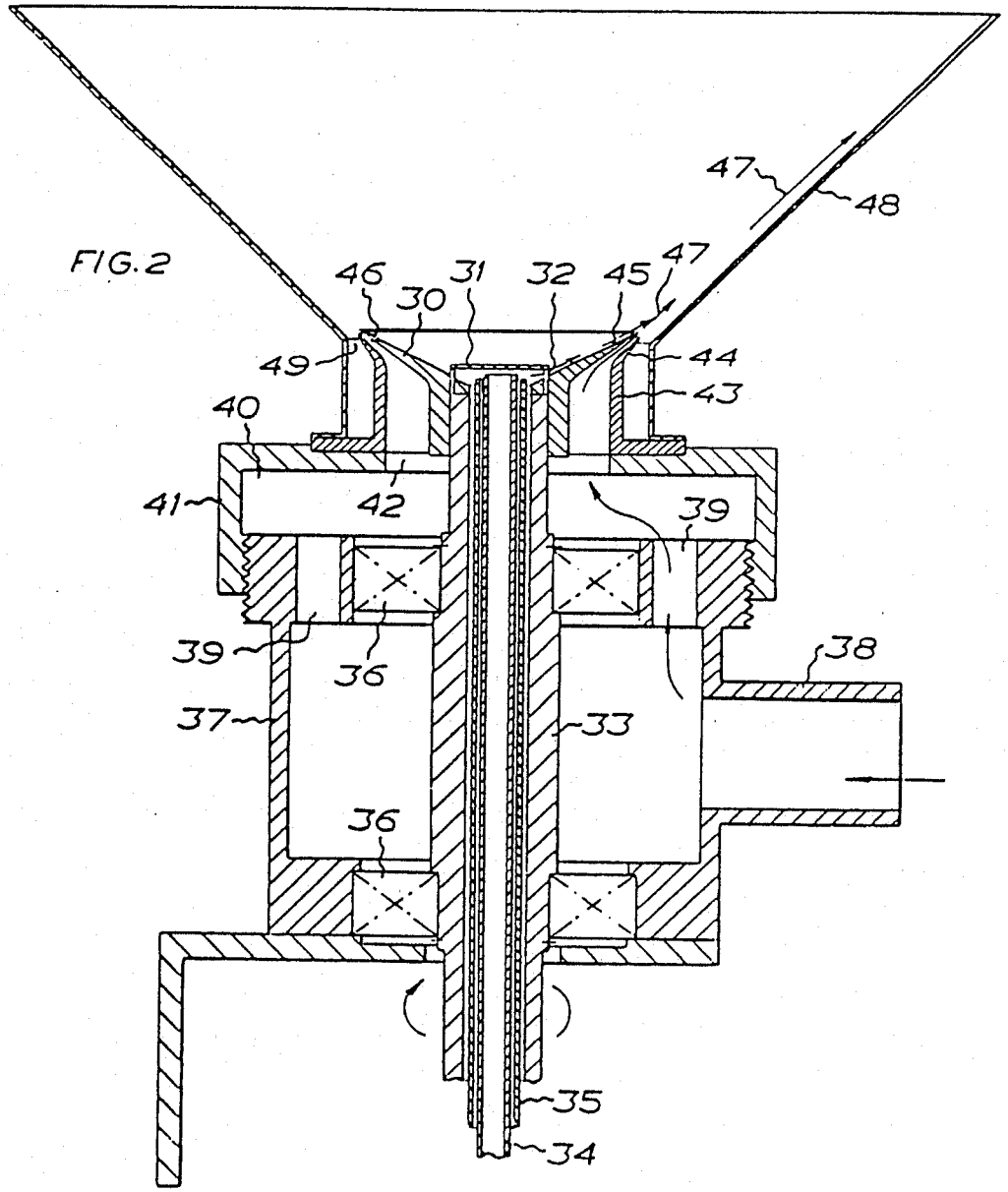
FIG. 2 shows in axial section one embodiment of a burner according to the invention.

FIG. 2 shows an advantageous embodiment of a burner according to the present invention. This burner has a rotary body 30 having a smooth conical inner side. The rotary body has an internal distribution baffle 31 which is suitably fixed to the inner side of the rotary body, thus leaving an annular gap 32 between the edge of the baffle and the inner side of the body 30. The body 30 is mounted on a rotary tubular shaft 33. Through the tubular shaft 33 there extends an inner supply pipe 34 for the fuel suspension to be combusted in the burner. A further fuel supply pipe 35 concentrically surrounding the inner pipe 34 is adapted to supply oil or gas in order readily to ensure the ignition of the coal/liquid suspension. The two pipes 34, 35 are stationary with respect to the shaft 33. The pipe 34 should have an inner diameter of at least about 4 mm so as to prevent the coal/liquid suspension from plugging the pipe. The gap 32 between the distribution baffle 31 and the inner side of the body 30 should be at least 1 mm in width.

The shaft 33 is mounted in bearings 36 provided in a housing 37 which at the same time serves as a distribution conduit for the supply and distribution of primary air. The primary air is fed into the housing 37 by a supply socket 38 and may flow through channels 39 past one of the bearings to a front space 40 which is defined by a lid 41 screwed onto the housing 37. On the front face of the lid there is a passageway 42 surrounded by a pipe socket 43 drawn out to form an outwardly directed flange or apex 44. The apex or flange 44 together with the rim 45 of the rotary body 30 forms an outlet nozzle 46 for the primary air. This outlet nozzle directs the air outwardly along arrows 47 as a conically diverging air stream. The angle of this air stream relative to the longitudinal axis of the burner and the other measurements correspond to what has been stated above in conjunction with the diagrammatic sketch in FIG. 1. The lid 41 further carries a baffle 48 which is conical and forms a guide baffle for the air stream 47. The conical portion of the baffle 48 departs from a location slightly behind the outer edges of the nozzle walls 44, 45 at a radial distance from the outer nozzle wall 44 such that there is a gap 49 between the outer nozzle wall 44 and the baffle 48. This gap is essential in order to avoid that the coal particles expelled from the rotary body 30 stick to the guide baffle 48 and form coal layers fused to the baffle. The distance between the starting line of the conically diverging air stream 47 and the guide baffle 48 makes it possible to enhance the effect of the construction of the invention. No air should be fed into the gap 49.

As the lid 41 is threaded onto an outer thread on the housing 37, the width of the mouth gap of the nozzle 46 may be varied for the supply of different amounts of primary air. When this adjustment of the amount of primary air is carried out, the guide baffle 48 will be moved together with the outer nozzle wall 43, 44 so that the gap 49 will be safely maintained.

The fact that the primary air is fed through the bearing housing for the shaft 33 ensures that the air stream will cool the bearings and thus reduce the heat load thereon.

In the embodiment of FIG. 2, concentric pipes 34, 35 are shown for the supply of the suspension and of the gas or oil fuel, respectively. These pipes may however also be arranged side by side in the tubular shaft 33.

Figure 3:
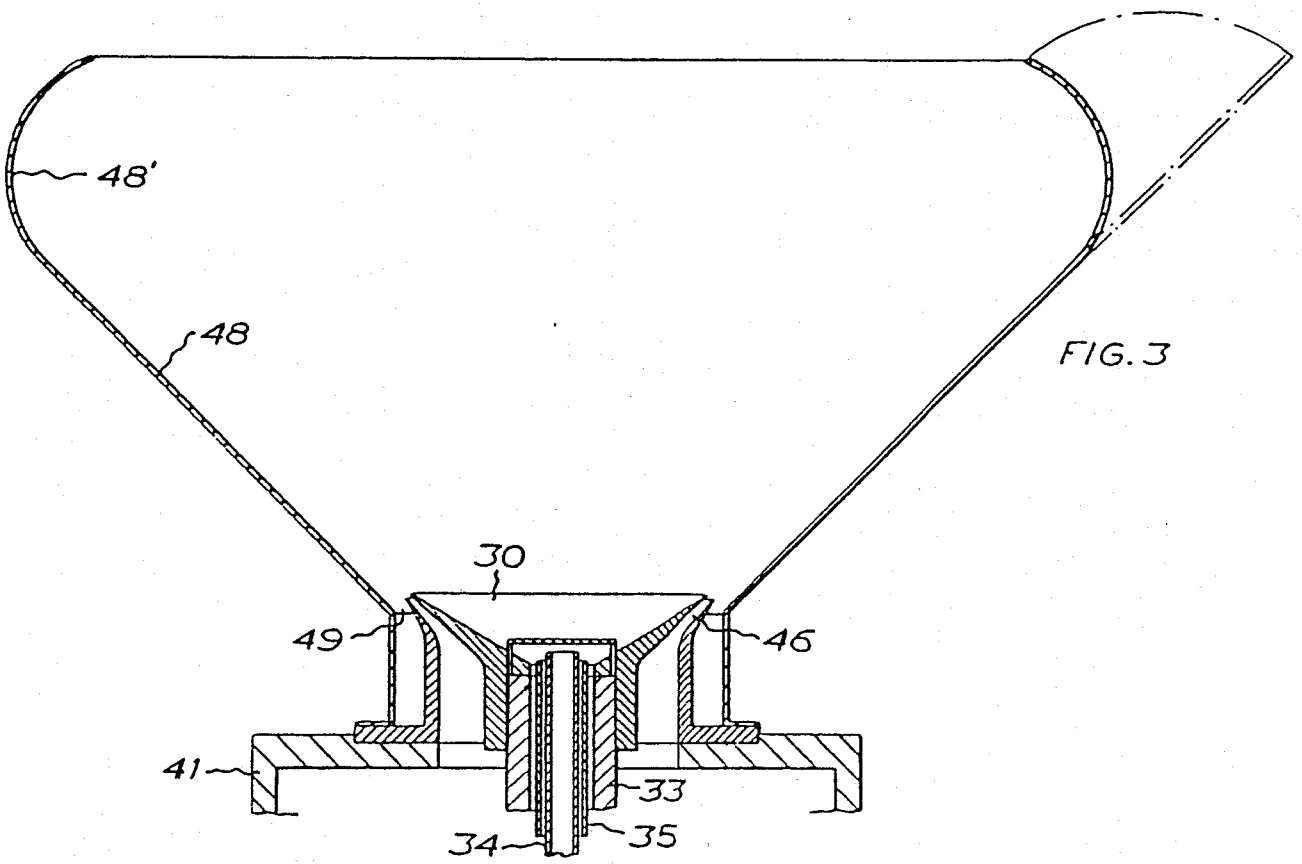
FIG. 3 shows in axial section a part of a modified embodiment of the burner of FIG. 2.

In FIG. 3 there is shown a modified embodiment of the burner of FIG. 2. In this modified embodiment, the guide baffle 48 is provided at its outer end with an iwnardly curved extension 48' which enhances the desired toroidal effect.

Figure 4:
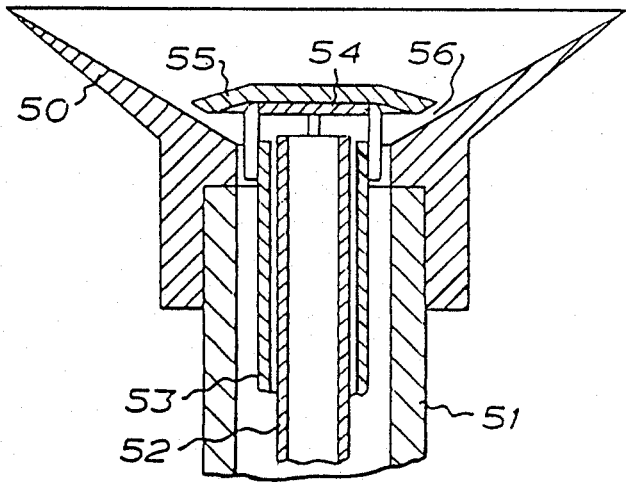
FIG. 4 shows in axial section another embodiment of a rotary cup in a burner according to the invention.

In the embodiments of FIGS. 1–3, the internal distribution baffle of the rotary body is fixedly mounted to the rotary body. FIG. 4 shows another possible mode of mounting the distribution baffle. Thus, in FIG. 4 there is shown a rotary body 50 fixedly mounted on a rotary tubular shaft 51. Through this shaft there extends a supply pipe 52 serving to supply the envisaged suspension of a fine-grained coal in liquid. A further pipe 53 which surrounds the pipe 52 defines, together with the pipe 52, an annular supply channel for a fuel gas or oil. On the outer end of the pipe 53 there is mounted a holder 54. A distribution baffle 55 is fixed to the outer side of this holder. Between the free edge of the baffle 55 and the inner side of the rotary body 50 there is provided a gap 56 which, as above, should be at least 1 mm in width. By this construction it is possible to produce a relative rotation between the distribution baffle 55 and the rotary body 50. Typically, the baffle 55 and the tube 53 are either stationary or caused to rotate in the opposite direction or at least at a different speed with respect to the rotary body 50. This relative movement provides for sufficient cleaning of the gap 56.

Figure 5:
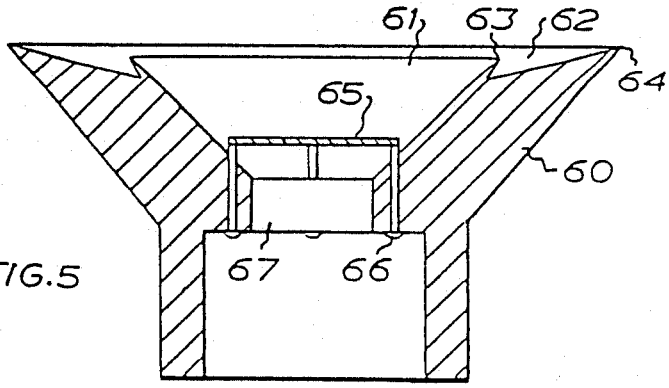
FIG. 5 shows in axial section a further embodiment of a rotary cup in a burner according to the present invention.

FIG. 5 shows a further embodiment of a rotary body 60 which may be used to advantage in a burner according to the present invention. Like the rotary body in FIG. 1, this rotary body has a stepped inner side with an inner portion 61 making an angle with the longitudinal axis of the burner, and an outer portion 62 making another, greater angle with the longitudinal axis of the burner. The inner portion 61 is drawn out to form an apex or a step 63. The function of this configuration of the inner side of the rotary body resides in that the suspension will first move outwards along the surface 61 while partially drying, the at least partially dried coal suspension (the speed of rotation may be for instance 5000–10000 r.p.m.) being flung by centrifugal force, radially outwards over the edge 63 such that the coal particles in the suspension hit the surface 62 and are loosened or broken up so as to leave the outer edge 64 of the rotary body in a more uniformly distributed state. As in the previous embodiments, the rotary body 60 has a distribution baffle 65 which is secured to the rotary body by pins 66. Through the opening 67 of the rotary body behind the baffle 65 there extends at least one supply pipe for the coal/liquid suspension but preferably also a pipe for the supply of ignition fuel.

As mentioned above, it may be advantageous in some cases to counteract the rotation of the mass of combustion gases within the guide baffle. In order to counteract such rotation it is possible, as shown in FIGS. 6–9, to provide the outer wall 70 of the annular air supply nozzle with grooves which may be directed radially outwardly as shown for grooves 71 in FIGS. 6–8, or which may be oriented in a direction opposite the direction of rotation of the rotary body, as shown for grooves 72 in the outer wall 70' in FIG. 9. The element 70,70' in FIGS. 6–9 is meant to replace e.g. the element 43 in FIG. 2.

Instead of using grooves for counteracting the rotation of the combustion gases, it is possible, as shown in FIG. 10, to provide the primary air nozzle with guide vanes 73 which are fixed to the inner side of the outer wall 74 of the nozzle and project towards the inner wall of the nozzle. The orientation of these guide vanes may be the same as described with reference to grooves 71 in the embodiment of FIGS. 6–9.

To support the supply of the coal/liquid suspension into the rotary body, it is possible to design the supply pipe as a screw conveyor, i.e. mount a rotating feed screw in the pipe 11, 34 or 52. This embodiment makes it possible further to lower the liquid content or increase the viscosity.

As stated above, the ignition of the coal/liquid suspension may be effected by means of an ignition flame produced by the separate feeding of oil or gas through separate supply pipes. It is however also possible to produce ignition by supplying through one and the same pipe, for instance pipe 11, first oil which is ignited, for instance electrically, and which is then successively admixed with the coal/liquid suspension until, finally, only coal/liquid suspension is fed in.

What we claim and desire to secure by Letters Patent is:

1. A rotary burner for burning a fuel consisting of a suspension of fine coal particles in a liquid, particularly water containing a suspending agent, said burner comprising:

a hollow conical rotary body with at least the outer rim portion of the inner side of said body forming an angle of 35°–80° with the axis of said body;

means defining a primary air supply nozzle surrounding said hollow conical rotary body and adapted to supply air along the peripheral edge of said body as a diverging air stream directed outwards away from said axis of said body at an angle of 30°–70°, the diverging air stream making less of an angle with said axis of said hollow conical rotary body than does said at least said outer rim portion of said inner side of said body;

a distribution baffle arranged transversely of said axis of said hollow conical rotary body;

an axially directed first fuel supply means having an outlet behind said distribution baffle for supplying thereto a fuel consisting of a suspension of fine coal particles in a liquid;

means for rotating said hollow conical rotary body to impart centrifugal force to the fuel, conveying the fuel outwardly and along said inner side of said hollow conical rotary body to the peripheral edge thereof;

a conical guide baffle surrounding said air supply nozzle defining means and said hollow conical rotary body and radially spaced from said air supply nozzle to form a gap between said conical guide baffle and said air supply nozzle, said conical guide baffle forming approximately the same angle with said axis of said hollow conical rotary body as does the diverging air stream;

said air supply nozzle defining means including guide means adapted to stabilize the diverging air stream and to counteract the rotation of the products of combustion and of the flame about said axis of the said hollow conical rotary body; and second fuel supply means having an outlet behind said distribution baffle for supplying a second fuel to said distribution nozzle.

2. A rotary burner as claimed in claim 1 wherein said conical guide baffle has an outer end with an inwardly curved extension.

3. A rotary burner as claimed in claim 1 wherein said inner side of said hollow conical rotary body has a series of conical steps arranged at different angles with respect to said axis of said body.

4. A rotary burner as claimed in claim 1 wherein said air supply nozzle defining means includes the outer side surface of said hollow conical rotary body.

5. A rotary burner as claimed in claim 1 wherein said distribution baffle is attached to said axially directed fuel supply pipe.

6. A rotary burner as claimed in claim 1 wherein said first fuel supply means includes a pipe positioned axially within said rotary body and said second fuel supply means includes a pipe which circumferentially surrounds the pipe of said first fuel supply means and is also axially positioned within said rotary body.

7. A rotary burner as claimed in claim 6 wherein said distribution baffle is secured to the pipe of said second fuel supply means.

8. A rotary burner as claimed in claim 7 further comprising means for rotating said second fuel supply means.

9. A rotary burner as claimed in claim 8 wherein said means for rotating said second fuel supply means rotates said distribution baffle in a direction opposite the direction said conical rotary body rotates.

10. A rotary burner as claimed in claim 8 wherein said means for rotating said second fuel supply means rotates said distribution baffle at a rate slower than the rate said conical rotary body rotates.

11. A rotary burner as claimed in claim 1 wherein said guide means adapted to stabilize the diverging air stream includes grooves formed in said air supply nozzle.

12. A rotary burner as claimed in claim 1 wherein said guide means adapted to stabilize the diverging air stream includes guide vanes.

* * * * *